US011053091B2

(12) United States Patent
Satou et al.

(10) Patent No.: US 11,053,091 B2
(45) Date of Patent: Jul. 6, 2021

(54) SHEET POSITION DETECTION APPARATUS, SHEET CONVEYANCE APPARATUS, AND IMAGE FORMATION APPARATUS

(71) Applicant: KONICA MINOLTA, INC., Tokyo (JP)

(72) Inventors: Masayuki Satou, Toyohashi (JP); Taisuke Minemura, Okazaki (JP); Shoichi Yoshikawa, Inagi (JP); Yoshiyuki Toso, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 196 days.

(21) Appl. No.: 16/425,103

(22) Filed: May 29, 2019

(65) Prior Publication Data

US 2019/0367308 A1 Dec. 5, 2019

(30) Foreign Application Priority Data

May 29, 2018 (JP) ..... JP2018-102369

(51) Int. Cl.
*G03G 15/00* (2006.01)
*G03G 21/14* (2006.01)
(Continued)

(52) U.S. Cl.
CPC ..... *B65H 7/20* (2013.01); *B65H 5/062* (2013.01); *B65H 7/08* (2013.01); *G03G 15/6529* (2013.01)

(58) Field of Classification Search
CPC ..... G03G 15/00; G03G 15/6529; B65H 7/00; B65H 7/02; B65H 7/08; B65H 7/10; B65H 7/20
See application file for complete search history.

(56) References Cited

U.S. PATENT DOCUMENTS 5,427,366 A 6/1995 Sakamori
5,918,876 A * 7/1999 Maruyama ..... B65H 5/062 271/228
(Continued)

FOREIGN PATENT DOCUMENTS

CN 104340701 A 2/2015
CN 106560747 A 4/2017
(Continued)

OTHER PUBLICATIONS

CNIPA First Office Action for corresponding CN Application No. 201910450525.8; dated Jul. 31, 2020.

*Primary Examiner* — Nguyen Q. Ha
(74) *Attorney, Agent, or Firm* — Cantor Colburn LLP

(57) ABSTRACT

Provided are a sheet position detection apparatus, a sheet conveyance apparatus, and an image formation apparatus. The sheet position detection apparatus has a first and a second conveyance roller which are arranged to oppose across a sheet to be conveyed and to nip the sheet, and a detector configured to detect an end position of the sheet, the detector has a light emitter and a light receptor arranged on the first conveyance roller side, the light emitter and the light receptor are arranged such that a light emitted from the light emitter is reflected on a reflective face of the second conveyance roller and enters the light receptor, and the detector detects passage of an end of the sheet based on a change in the amount of light entering the light receptor when the sheet shields a light emitted from the light emitter.

16 Claims, 12 Drawing Sheets

(51) Int. Cl.

| | |
|---|---|
| ***B65H 7/08*** | (2006.01) |
| ***B65H 9/16*** | (2006.01) |
| ***B65H 7/20*** | (2006.01) |
| ***B65H 5/06*** | (2006.01) |

(56) References Cited

U.S. PATENT DOCUMENTS

| | | | | |
|---|---|---|---|---|
| 10,766,727 | B2 * | 9/2020 | Yanagiuchi | B65H 7/14 |
| 2012/0072015 | A1 * | 3/2012 | Takahashi | G03G 15/6564 700/229 |
| 2015/0028533 | A1 | 1/2015 | Kato et al. | |
| 2017/0097604 | A1 | 4/2017 | Nakamura | |
| 2018/0282089 | A1 * | 10/2018 | Tokonami | G03G 15/6511 |
| 2019/0129345 | A1 * | 5/2019 | Okubo | G03G 15/6561 |

FOREIGN PATENT DOCUMENTS

| | | | | | |
|---|---|---|---|---|---|
| JP | 08133530 | A | * | 5/1996 | B65H 9/14 |
| JP | 10032682 | A | * | 2/1998 | G03G 15/00 |
| JP | 2000289888 | A | * | 10/2000 | B65H 7/14 |
| JP | 2009046294 | A | * | 3/2009 | B65H 7/02 |
| JP | 2014112138 | A | | 6/2014 | |

* cited by examiner

SHEET POSITION DETECTION APPARATUS, SHEET CONVEYANCE APPARATUS, AND IMAGE FORMATION APPARATUS

CROSS-REFERENCE TO RELATED APPLICATION

The present application claims priority under 35 U.S.C. § 119 to Japanese Patent Application No. 2018-102369, filed on May 29, 2018, is incorporated herein by reference in its entirety.

BACKGROUND

1. Technological Field

The present invention relates to a sheet position detection apparatus, a sheet conveyance apparatus, and an image formation apparatus.

2. Description of the Related Art

An image formation apparatus such as a copying machine needs to form an image with excellent position accuracy. However, a sheet may be tilted due to the kind of the sheet on which an image is to be formed, temperature or humidity during sheet conveyance, characteristics of parts such as a conveyance roller, or the like, and if an image is formed in such a state, the position accuracy in image formation deteriorates.

Thus, a sheet conveyance apparatus in the image formation apparatus has a sheet resist mechanism in a steering system for correcting a tilt of a sheet. The sheet resist mechanism corrects a tilt of a sheet on the basis of a detected sheet position. That is, a sheet position needs to be detected with high accuracy in order to correct a tilt of a sheet with high accuracy.

However, floating (curve) of a sheet is caused due to curl or the like depending on a sheet state, and thus a sheet position is difficult to detect with high accuracy.

On the other hand, a sheet position detection unit may be a non-contact type sensor having a light emission part and a light reception part. The non-contact type sensor is preferable because it does not cause fold or damage on a sheet when detecting a sheet position unlike a contact type sensor.

For example, Japanese Patent Application Laid-Open No. 2014-112138 discloses a configuration in which a light emission part and a light reception part in a non-contact type sensor are arranged to vertically sandwich a sheet to be conveyed.

SUMMARY

When the arrangement configuration of the light emission part and the light reception part in the non-contact type sensor described in Japanese Patent Application Laid-Open No. 2014-112138 is applied to detect a sheet position, however, there arises a problem in which an improvement in detection accuracy is limited.

For example, floating on a sheet is eliminated while the sheet is nipped by conveyance rollers, which is preferable to detect a sheet position near the nip portion. On the other hand, the light emission part and the light reception part are arranged to sandwich a sheet to be conveyed. Thus, a position where a light emitted from the light emission part passes near the nip portion and is not shielded (interfered) by the conveyance rollers is away from the conveyance rollers.

That is, the distance between the light emission part and the light reception part needs to be increased. Therefore, a reduction in detection accuracy due to floating on a sheet can be restricted, but a reduction in detection accuracy due to the increased distance between the light emission part and the light reception part can be caused, and an improvement in detection accuracy is not enough.

On the other hand, the distance between the light emission part and the light reception part can be shortened in a configuration in which a light emitted from the light emission part does not pass near the nip portion, but a reduction in detection accuracy due to floating on a sheet cannot be restricted, and a sheet position is difficult to detect with high accuracy.

The present invention has been made in order to solve the problems of the above conventional technique, and is directed to provide a sheet position detection apparatus capable of detecting a sheet position with high accuracy irrespective of a sheet state, a sheet conveyance apparatus, and an image formation apparatus.

To achieve at least one of the above-mentioned objects, according to an aspect of the present invention, a sheet position detection apparatus reflecting one aspect of the present invention comprises a first conveyance roller and a second conveyance roller which are arranged to oppose across a sheet to be conveyed and to nip the sheet, and a detector that detects an end position of the sheet. The detector has a light emitter and a light receptor which are arranged on the first conveyance roller side, the light emitter and the light receptor are arranged such that a light emitted from the light emitter is reflected on a reflective face of the second conveyance roller and enters the light receptor, and the detector detects passage of an end of the sheet on the basis of a change in the amount of light entering the light receptor when the sheet shields a light emitted from the light emitter.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
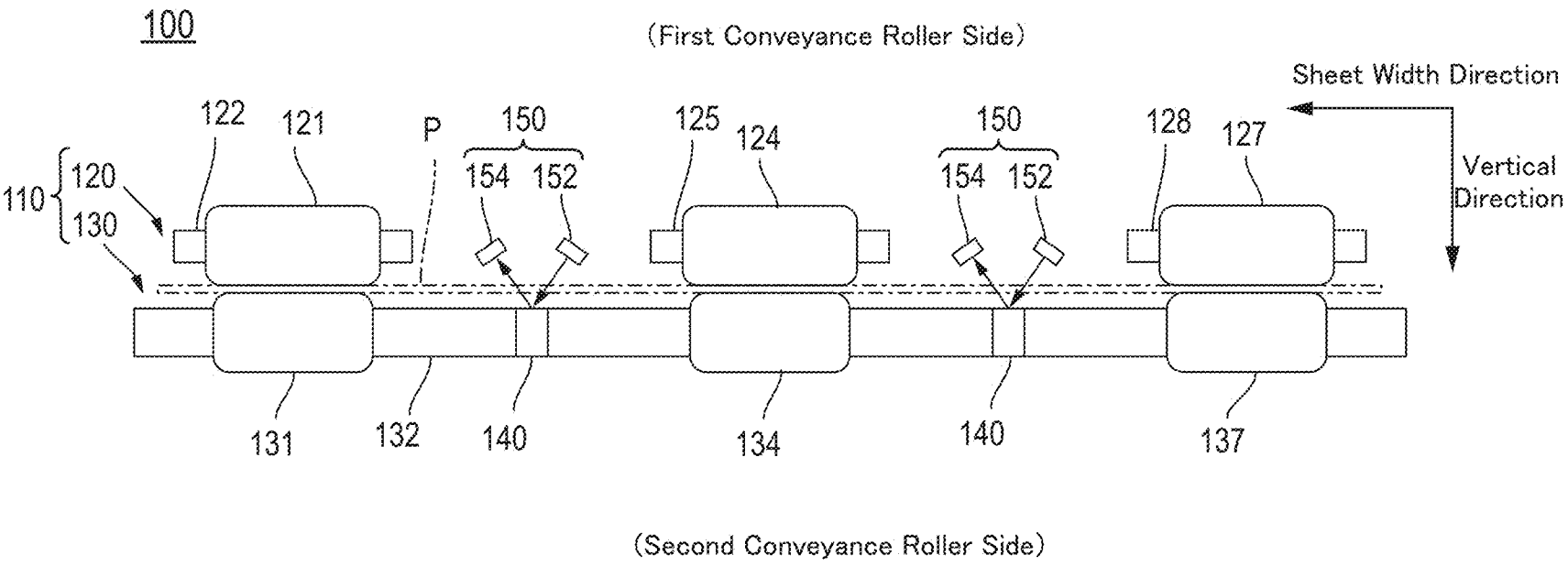
FIG. 1 is a front view for explaining a sheet position detection apparatus according to an embodiment of the present invention.

Hereinafter, one or more embodiments of the present invention will be described with reference to the drawings. However, the scope of the invention is not limited to the disclosed embodiments. In addition, in some cases, dimensional ratios in the drawings are exaggerated and different from actual ratios for convenience of the description.

Figure 2:
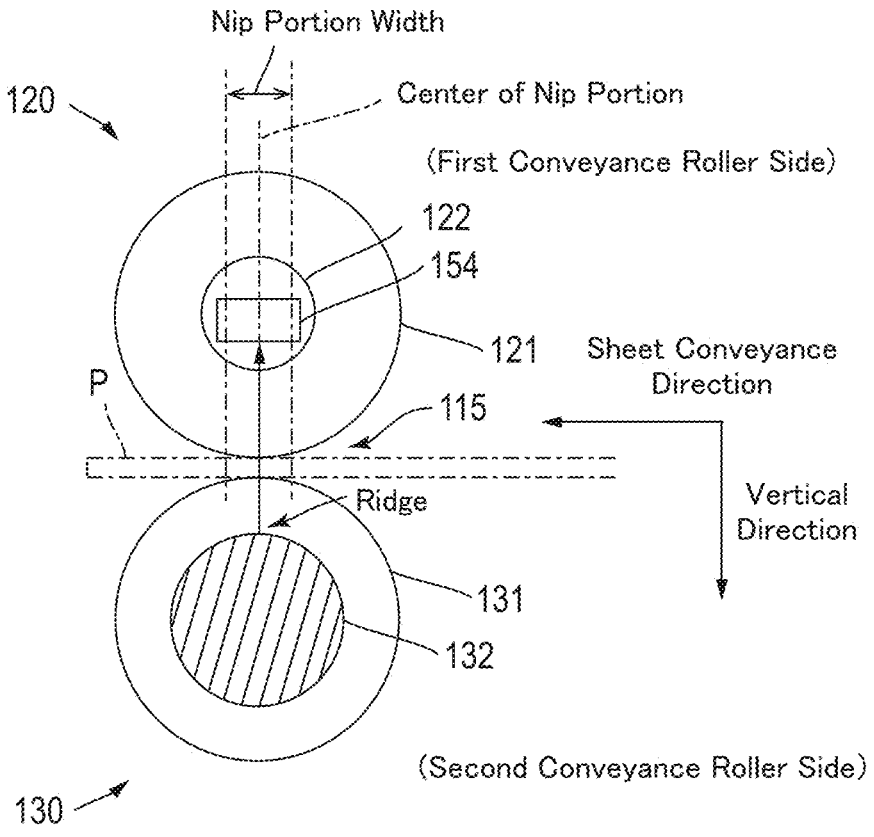
FIG. 2 is a cross-section view for explaining the sheet position detection apparatus according to the embodiment of the present invention.
Figure 3:
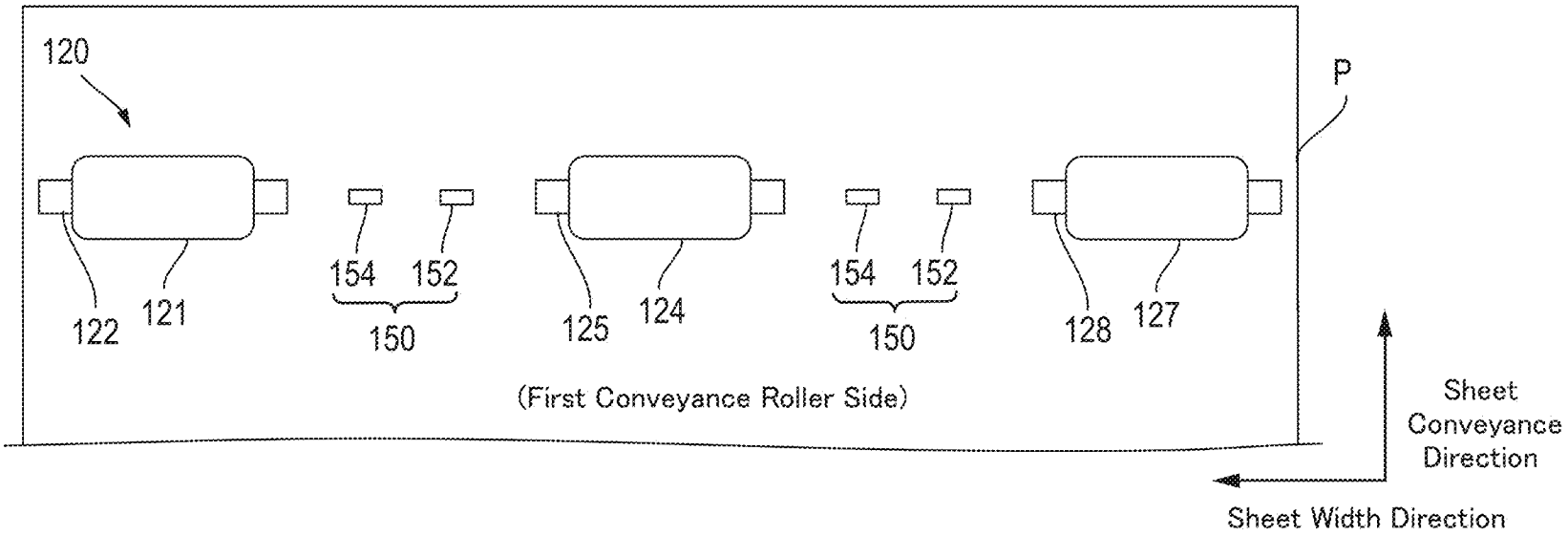
FIG. 3 is a plan view for explaining a first conveyance roller illustrated in FIG. 1.
Figure 4:
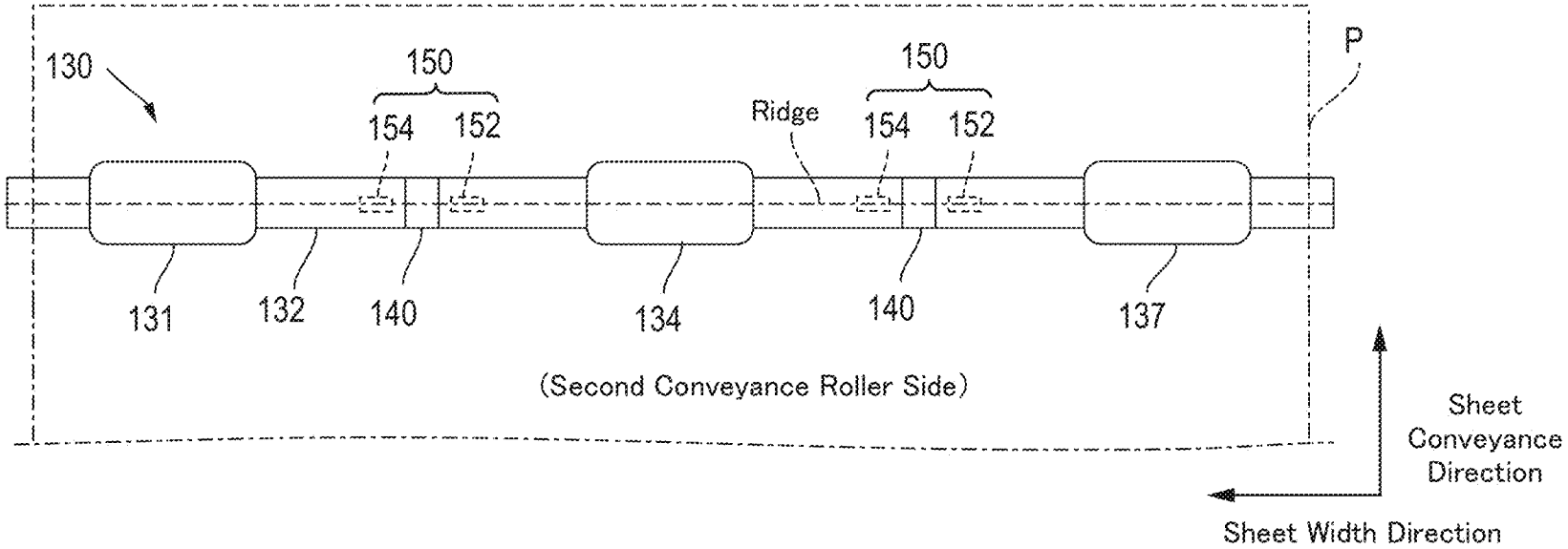
FIG. 4 is a plan view for explaining a second conveyance roller illustrated in FIG. 1.

FIG. 1 and FIG. 2 are a front view and a cross-section view for explaining a sheet position detection apparatus according to an embodiment of the present invention, respectively. FIG. 3 and FIG. 4 are plan views for explaining a first conveyance roller and a second conveyance roller illustrated in FIG. 1, respectively.

A sheet position detection apparatus 100 illustrated in FIG. 1 has a pair of conveyance rollers 110 and transmissive sensors 150.

The pair of conveyance rollers 110 is configured of a first conveyance roller 120 and a second conveyance roller 130 arranged to oppose across a sheet P to be conveyed, and is arranged in a direction (denoted as sheet width direction below) orthogonal to a sheet conveyance direction.

The first conveyance roller 120 is positioned vertically above the sheet P. The first conveyance roller 120 is a driven roller, and has cylindrical roller parts 121, 124, 127, shafts 122, 125, 128, and support parts (not illustrated) as illustrated in FIG. 3.

The roller parts 121, 124, and 127 are arranged apart in the sheet width direction. The shafts 122, 125, and 128 are the shafts of the roller parts 121, 124, and 127, respectively, and are short. The support parts rotatably support the shafts 122, 125, and 128, and the roller parts 121, 124, and 127 can be driven and rotated.

The second conveyance roller 130 is positioned vertically below the sheet P. The second conveyance roller 130 is a driving roller, and has cylindrical roller parts 131, 134, 137, a shaft 132, and a reflective face 140 as illustrated in FIG. 4.

The roller parts 131, 134, and 137 are arranged apart in the sheet width direction. The shaft 132 is a common shaft (roller shaft) among the roller parts 121, 124, and 127, is long, and is rotated and driven by a drive source (not illustrated). That is, the roller parts 131, 134, and 137 are rotated and driven. In addition, the roller parts 131, 134, and 137 are aligned in their positions with the roller parts 121, 124, and 127 of the first conveyance roller 120 to form a nip portion 115 across the sheet P (to be able to nip the sheet P).

The reflective face 140 is configured of a site of the shaft 132 positioned between the roller part 131 and the roller part 134 and a site of the shaft 132 positioned between the roller part 134 and the roller part 137. The reflective face 140 can be configured of the roller parts 131, 134, and 137, for example, not limited to being configured of the shaft 132. Further, the reflective face 140 is not limited to being configured of the cylindrical parts (the roller parts 131, 134, 137 and the shaft 132) of the second conveyance roller 130.

The transmissive sensors 150 are detection parts (detectors) for detecting an end position of the sheet P, and are arranged between the roller part 121 and the roller part 124 and between the roller part 124 and the roller part 127 on the first conveyance roller 120 side. The transmissive sensors 150 each have a light emission part (light emitter) 152 and a light reception part (light receptor) 154. An end of the sheet P is a sheet tip in the sheet conveyance direction according to the present embodiment.

The light emission part 152 incorporates a light source, and emits a light as a medium for detecting an end position of the sheet P. The light reception part 154 incorporates a photoelectric conversion device, and converts a light emitted from the light emission part 152 into an electric signal. The light emission part 152 and the light reception part 154 are arranged apart in the axial direction of the first conveyance roller 120 such that the light emitted from the light emission part 152 is reflected on the reflective face 140 of the second conveyance roller 130 to enter the light reception part 154.

Thus, when the sheet P passing between the first conveyance roller 120 and the second conveyance roller 130 (at the nip portion 115) shields the light emitted from the light emission part 152, the amount of light reflected on the reflective face 140 of the second conveyance roller 130 and entering the light reception part 154 reduces, and the electric characteristics of the photoelectric conversion device of the light reception part 154 changes. That is, passage of an end of the sheet P can be detected when the sheet P shields the light emitted from the light emission part 152 and the amount of light entering the light reception part 154 changes.

The light emission part 152 and the light reception part 154 in the transmissive sensor 150 are arranged on the opposite side (on the first conveyance roller 120 side) by use of one (the second conveyance roller 130) of the pair of conveyance rollers nipping the sheet P as reflective face in the sheet position detection apparatus 100 as described above. Therefore, even when the distance between the light emission part 152 and the light reception part 154 is shortened, there can be configured such that a light emitted from the light emission part 152 passes near the nip portion 115 (above the nip portion). Thus, a reduction in sheet position detection accuracy due to floating on a sheet P and a reduction in detection accuracy due to a longer distance between the light emission part 152 and the light reception part 154 can be restricted.

The reflective face 140 of the second conveyance roller 130 is a cylindrical part of the second conveyance roller 130 (a cylindrical surface of the shaft 132), and thus a reflection point where a light emitted from the light emission part 152 returns to the light reception part 154 is limited on the ridge of the cylindrical part (see FIG. 2 and FIG. 4), and the light returning to the light reception part 154 (reflected light) has directivity. Thus, the performance of detecting a light returning to the light reception part 154 can be enhanced without a slit provided between the reflective face 140 and the light reception part 154. In addition, the ridge corresponds to the center of the nip portion.

The light emission part 152 and the light reception part 154 in the transmissive sensor 150 are positioned on the first conveyance roller 120 side positioned vertically above the sheet P. Thus, contaminations due to sheet powder of the sheet P can be avoided. In addition, the first conveyance roller 120 can be arranged vertically below and the second conveyance roller 130 can be arranged vertically above as needed.

A plurality of transmissive sensors 150 are arranged apart in the sheet width direction. Thus, a tilt of the sheet P relative to the sheet width direction can be detected (calculated) on the basis of a difference in timings (temporal difference) to detect a sheet end by the transmissive sensors 150.

It is preferable that the reflective face 140 is configured of a mirror-finished mirror face. In this case, it is possible to restrict a reduction in the amount of reflected light (to increase the mirror reflection component and to reduce the diffused reflection component) and to enhance the detection accuracy. It is preferable that mirror finishing is performed only on the reflective face 140. In this case, it is possible to reduce the surface processing cost.

A plurality of transmissive sensors 150 do not need to be arranged. Further, the transmissive sensors 150 can be arranged on the second conveyance roller side positioned vertically below and the reflective face 140 can be arranged in the first conveyance roller 120 positioned vertically above.

The numbers of first conveyance rollers 120 and second conveyance rollers 130 are not limited to three, respectively, and can be set depending on the sheet width as needed, for example. The first conveyance roller 120 can also be configured to have a single common shaft. Further, the roller parts 131, 134, and 137 in the second conveyance roller 130 can also be configured to have separate shafts, respectively.

An exemplary apparatus in which the sheet position detection apparatus 100 is incorporated will be described below.

Figure 5:
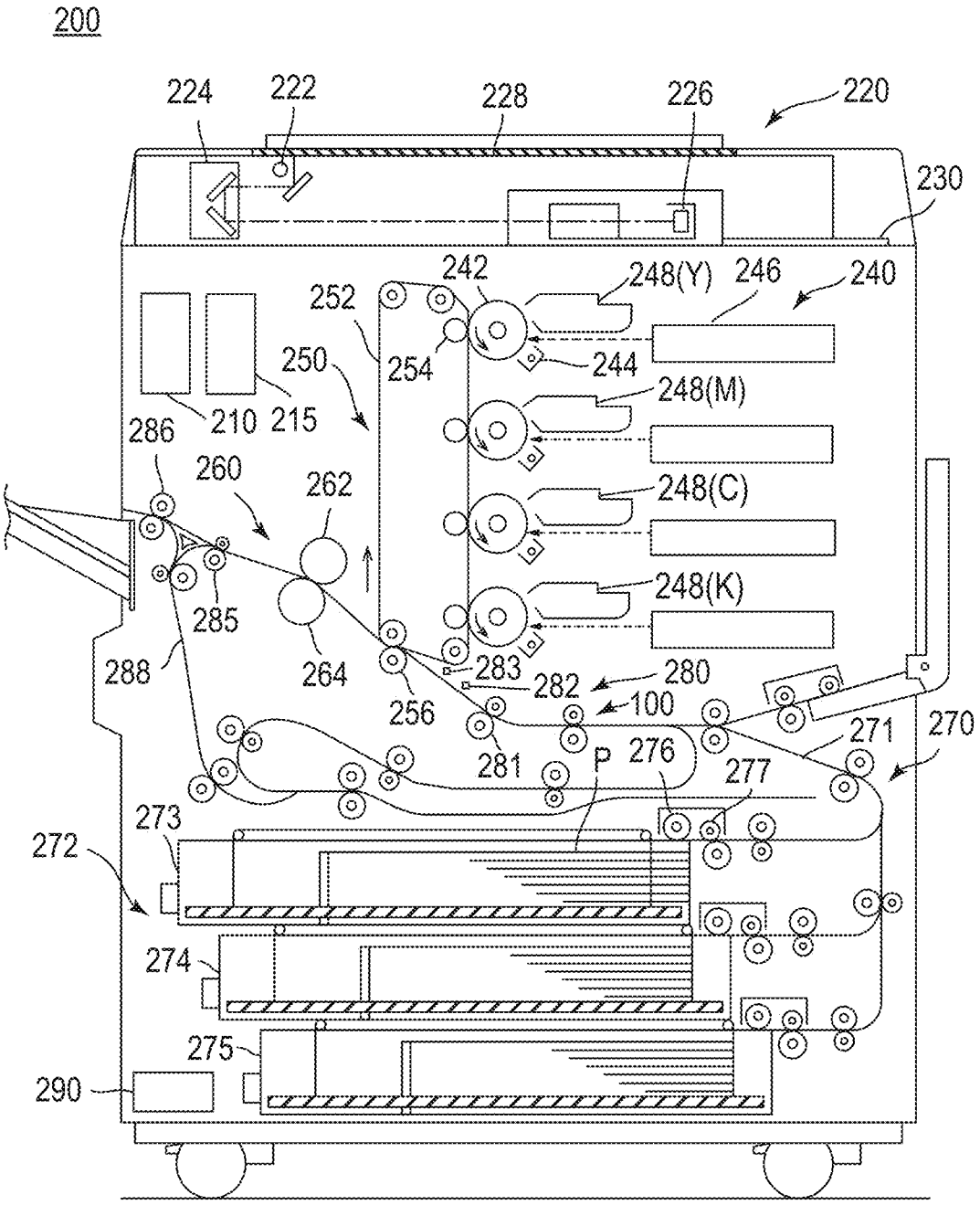
FIG. 5 is a schematic diagram for explaining an image formation apparatus and a sheet conveyance apparatus according to the embodiment of the present invention.

FIG. 5 is a schematic diagram for explaining an image formation apparatus and a sheet conveyance apparatus according to the embodiment of the present invention.

An image formation apparatus 200 illustrated in FIG. 5 is a MFP (Multi-Function Peripheral) having a copying function, a printer function, and a scanning function, and has a control part 210, a storage part 215, an image reading part 220, an operation display part 230, image formation parts (image former) 240, a transfer part 250, a fixing part 260, a sheet conveyance part 270, and a communication interface 290. In addition, the sheet position detection apparatus 100 is incorporated in a resist mechanism 280 in the sheet conveyance part 270 as described below.

The control part 210 is a control circuit configured of a microprocessor (CPU: Central Processing Unit) for controlling each of the above parts and performing various calculation processings by programs, ASIC (Application Specific Integrated Circuit), or the like, and each function of the image formation apparatus 200 is performed when the control part 210 executes a program corresponding to each function.

The storage part 215 is configured in a combination of ROM (Read Only Memory), RAM (Random Access Memory), and HDD (Hard Disk Drive) as needed, for example. The ROM is a read only storage apparatus for storing various programs and various items of data. The RAM is a high-speed random access storage apparatus as a working area for temporarily storing programs and data. The HDD is a large-capacity random access storage apparatus for storing various programs and various items of data.

The image reading part 220 is used to generate image data of a document, and has a light source 222, an optical system 224, and an imaging device 226. The light source 222 irradiates a light on a document placed on a reading face 228, and its reflected light routes through the optical system 224 and is imaged on the imaging device 226 which moves to the reading position. The imaging device 226 is configured of a line image sensor, for example, and generates (photoelectrically converts to) an electric signal depending on the intensity of the reflected light. The generated electric signal is input into the image formation parts 240 after the image processing. The image processing is A/D conversion, shading correction, filter processing, image compression processing, or the like. The image reading part 220 can have ADF (Auto Document Feeder), for example.

The operation display part 230 is configured of a touch panel and a physical keyboard, for example, and also serves as an output unit and an input unit. The touch panel is used to notify the user of device configuration, print job progress situation, sheet jamming situation, currently-changeable setting, and the like. The physical keyboard is used by the user to input characters, to make various settings, and to make various instructions (inputs) such as instruction to start.

A plurality of image formation parts 240 are provided in order to form an image on the sheet P, and correspond to Y (yellow), M (magenta), C (cyan), and K (black) from the top, respectively. Each of the image formation parts 240 has a photosensitive drum 242, a charging part 244, an optical writing part 246, and a development apparatus 248.

The photosensitive drum 242 is an image carrier having a photosensitive layer made of resin such as polycarbonate containing organic photo conductor (OPC) and is configured to rotate at a predetermined speed. The charging part 244 is configured of corona discharge electrodes arranged around the photosensitive drum 242, and charges the surface of the photosensitive drum 242 by generated ions.

The optical writing part 246 incorporates a scanning optical apparatus therein, lowers the potential of an exposed part by exposing the photosensitive drum 242 charged on the basis of raster image data, and forms a charge pattern (electrostatic latent image) corresponding to the image data.

The development apparatus 248 moves its housing development agent to the photosensitive drum 242 thereby to develop the electrostatic latent image formed on the photosensitive drum 242. The development agent is made in a mixture of carrier and toner corresponding to each color, and the electrostatic latent image is visualized by the toner.

The transfer part 250 has an intermediate transfer belt 252, primary transfer rollers 254, and a secondary transfer roller 256. The intermediate transfer belt 252 is wound on the primary transfer roller 254 and a plurality of rollers, and is supported to be able to travel. A plurality of primary transfer rollers 254 are provided and correspond to the colors Y (yellow), M (magenta), C (cyan), and K (black) from the top, respectively. The secondary transfer roller 256 is arranged outside the intermediate transfer belt 252, and is configured such that the sheet P can pass between the secondary transfer roller 256 and the intermediate transfer belt 252.

A toner image of each color formed by the image formation parts 240 is sequentially transferred onto the intermediate transfer belt 252 by the primary transfer rollers 254 so that a color toner image is formed in which the respective layers of yellow, magenta, cyan, and black overlap. The formed toner image is transferred onto the sheet P to be conveyed by the secondary transfer roller 256.

The fixing part 260 is used to fix the color image transferred onto the sheet P, and has a fixing roller (heating roller) 262 and a pressure roller 264. The sheet P has pressure and heat applied when passing between the fixing roller 262 and the pressure roller 264 (at the nip portion), and the toners thereon are melted so that the color image is fixed.

The sheet conveyance part 270 is a sheet conveyance apparatus having a sheet feeding part 272, the resist mechanism 280, a fixing conveyance roller 285, a sheet discharging roller 286, and a sheet inversion part 288.

The sheet feeding part 272 has sheet feeding trays 273 to 275 housing the sheets P, a feeding roller 276, and a separation roller 277. The feeding roller 276 and the separation roller 277 feed the sheets from the sheet feeding trays 273 to 275 to a conveyance path 271 of the sheet conveyance part 270 one by one.

The resist mechanism 280 conveys the sheets P from the sheet feeding part 272 to the secondary transfer roller 256, and makes tilt correction and deviation correction of the sheets P at this time. In addition, the reference numerals 281, 282, and 283 indicate a resist roller, a deviation detection sensor, and a tip timing detection sensor, respectively.

The fixing conveyance roller 285 conveys the sheet P passing through the secondary transfer roller 256 and the fixing part 260 toward the sheet discharging roller 286. The sheet discharging roller 286 discharges the conveyed sheet P to the outside of the apparatus.

The sheet inversion part 288 is used to introduce the sheet P passing through the fixing conveyance roller 285 not into the conveyance path toward the sheet discharging roller 286 but into the conveyance path between the sheet feeding trays 273 to 275 and the sheet discharging roller 286. Thereby, the front and back of the sheet P can be inverted and discharged, or an image can be formed on both sides of the sheet P.

The communication interface 290 is an expansion apparatus (LAN board) for adding a communication function of connecting a computer for transmitting data such as a print job via a network to the image formation apparatus 200. The network is configured of various networks such as LAN (Local Area Network), WAN (Wide Area Network) in which LANs are connected via a dedicated line, Internet, or combination thereof.

The resist mechanism 280 in the sheet conveyance part 270 will be described below.

Figure 6:
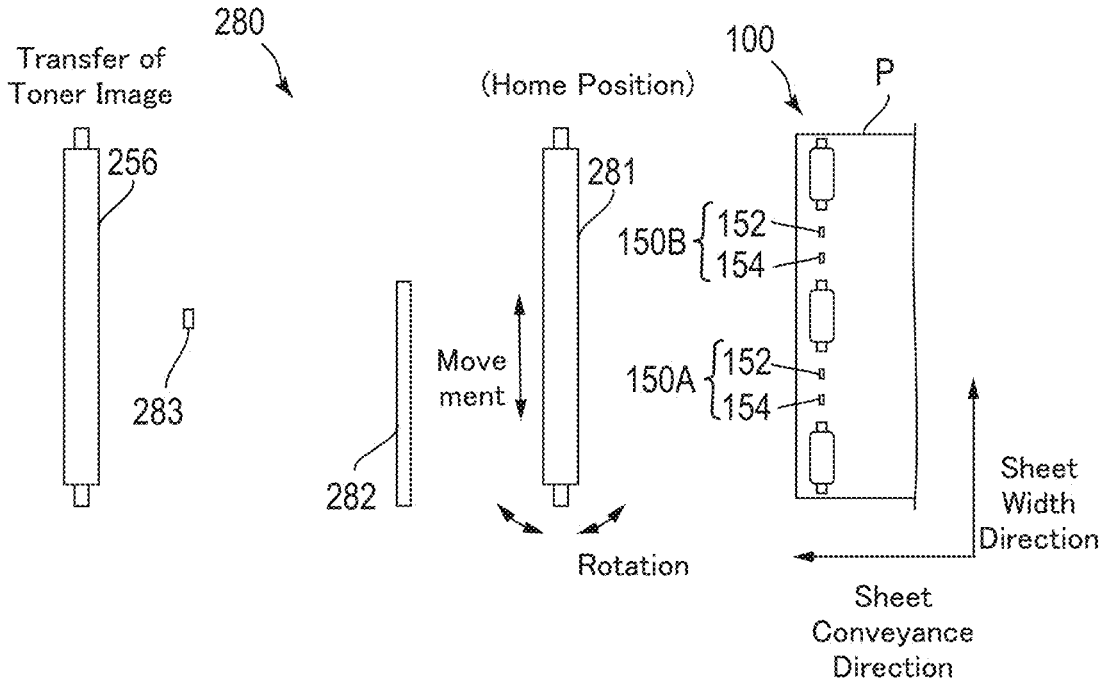
FIG. 6 is a schematic diagram for explaining a resist mechanism incorporating the sheet position detection apparatus illustrated in FIG. 5 therein.

FIG. 6 is a schematic diagram for explaining the sheet position detection apparatus and the resist mechanism illustrated in FIG. 5.

The resist mechanism 280 is in a steering system, and has the sheet position detection apparatus 100, the resist roller 281, the deviation detection sensor 282, and the tip timing detection sensor 283 as illustrated in FIG. 6.

The sheet position detection apparatus 100 has two transmissive sensors 150 as described above, and can detect a tilt of the sheet P relative to the sheet width direction orthogonal to the sheet conveyance direction. Thus, the sheet position detection apparatus 100 is arranged on the upstream side of the resist roller 281 in the sheet conveyance direction, and is applied as a tilt detection sensor. It should be noted that one and the other of the transmissive sensors 150 will be referred to as front sensor 150A and rear sensor 150B hereinbelow.

The resist roller 281 is a steering roller (correction roller) which is configured to be rotatable (swingable) about one end thereof and to be movable in the sheet width direction. The resist roller 281 is rotated in order to correct a tilt of the sheet P on the basis of the detected tilt by the sheet position detection apparatus 100. The resist roller 281 is moved in order to correct a deviation of the sheet P.

The deviation detection sensor 282 is configured of a line sensor in which photoelectric conversion devices are arranged in the sheet width direction, for example. The deviation detection sensor 282 is arranged on the downstream side of the resist roller 281 in the sheet conveyance direction, and is configured to detect a deviation of the sheet P in the sheet width direction after the tilt correction. The detected deviation is used for calculating the amount of movement of the resist roller 281.

The tip timing detection sensor 283 is arranged between the deviation detection sensor 282 and the secondary transfer roller 256, and is configured to be able to detect a tip of the sheet P and to be able to adjust a timing when the sheet P reaches the secondary transfer roller 256. In addition, the tip timing detection sensor 283 does not necessarily need to be arranged between the deviation detection sensor 282 and the secondary transfer roller 256.

The tilt correction and the deviation correction will be described below in detail.

Figure 7A:
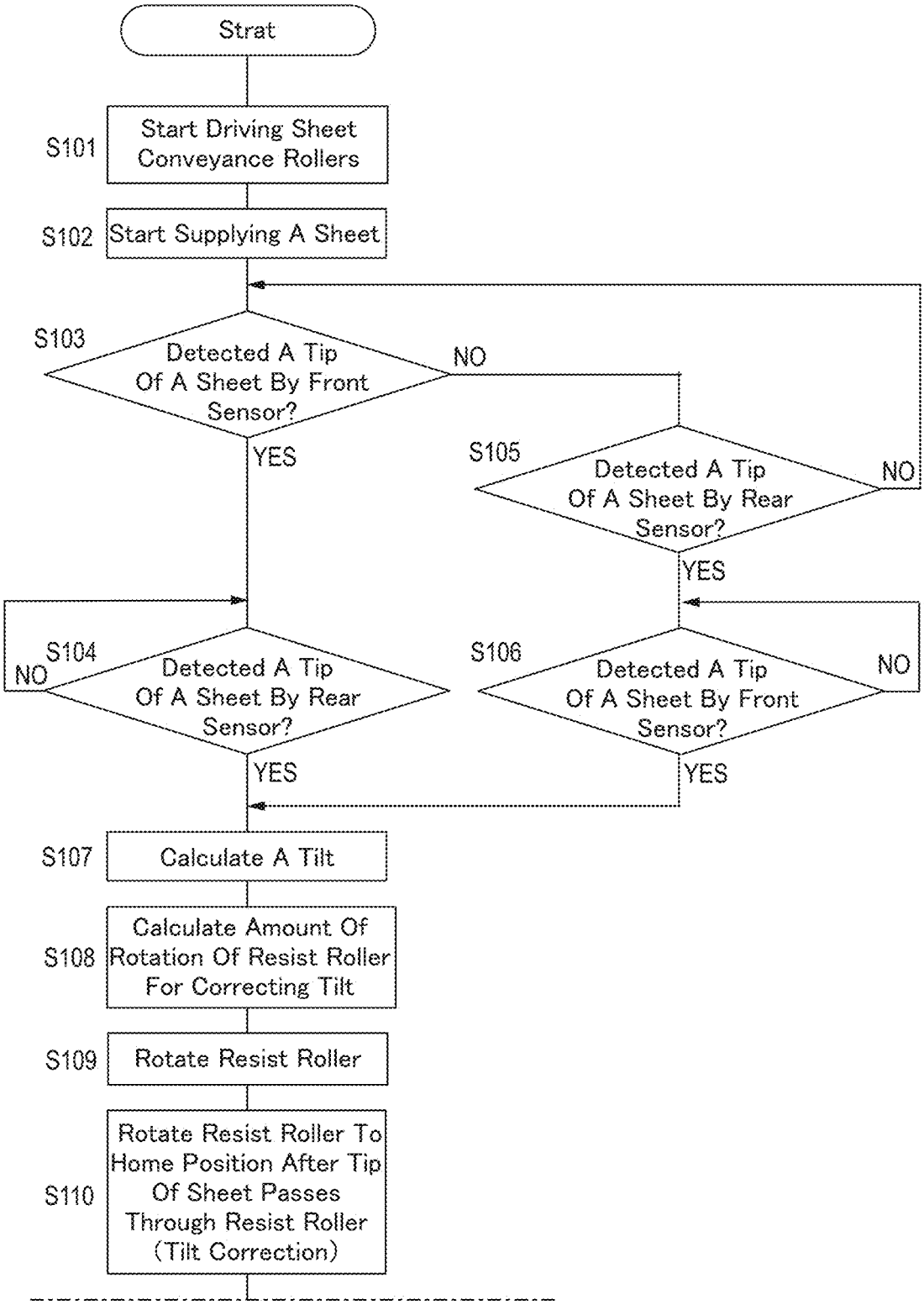
FIG. 7A is a flowchart for explaining tilt correction and deviation correction in the resist mechanism illustrated in FIG. 6.
Figure 7B:
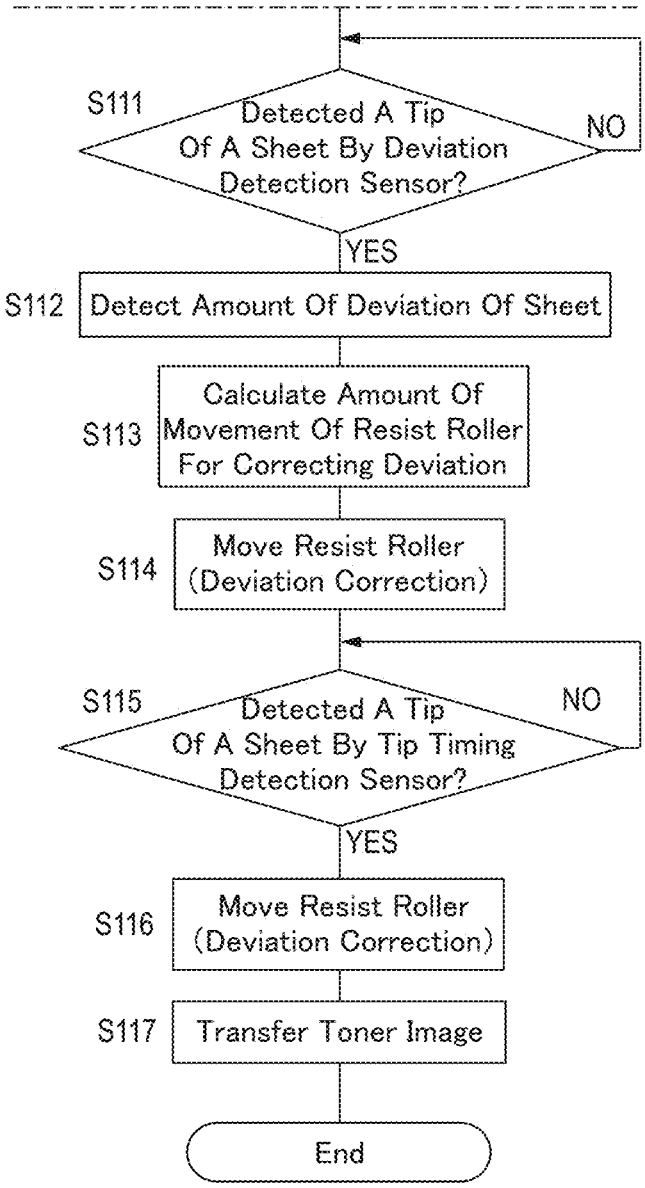
FIG. 7B is a flowchart subsequent to FIG. 7A.
Figure 8A:
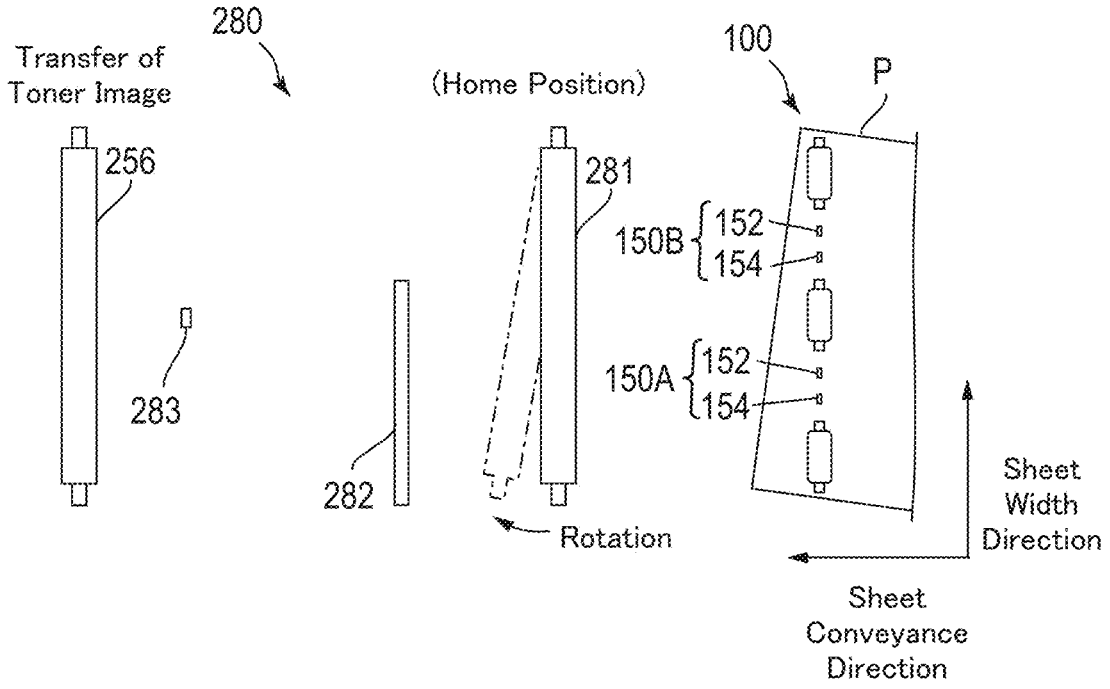
FIG. 8A is a schematic diagram for explaining exemplary rotation of a resist roller in step S109 illustrated in FIG. 7A.
Figure 8B:
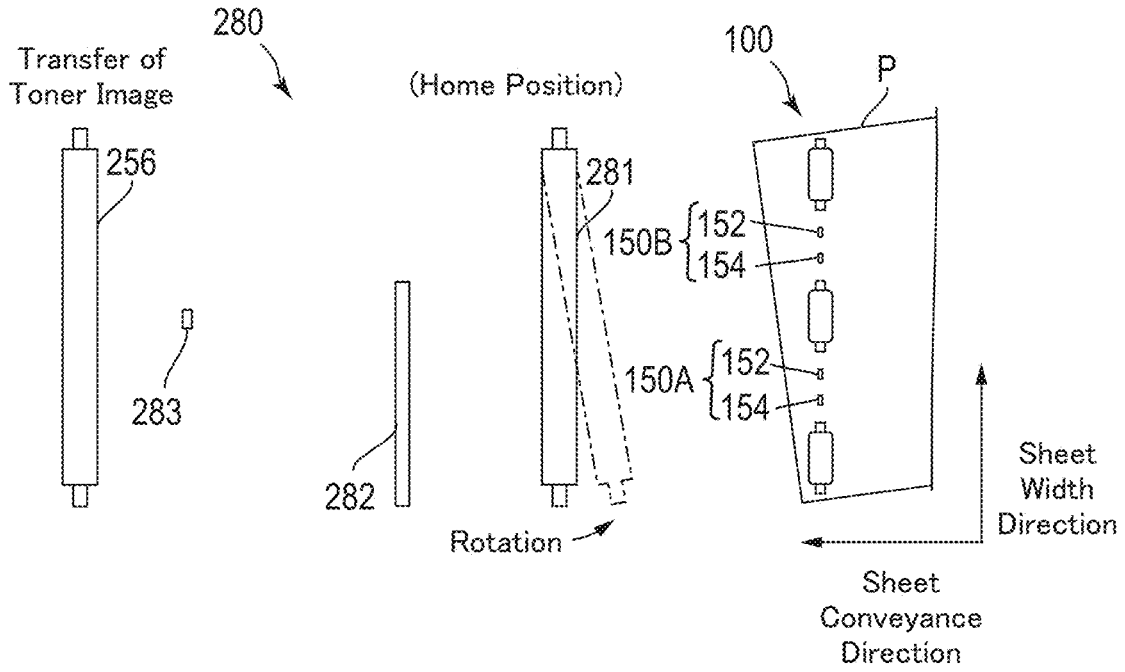
FIG. 8B is a schematic diagram for explaining another exemplary rotation of the resist roller in step S109 illustrated in FIG. 7A.

FIG. 7A and FIG. 7B are flowcharts for explaining the tilt correction and the deviation correction in the resist mechanism illustrated in FIG. 6, respectively, and FIG. 8A and FIG. 8B are schematic diagrams for explaining exemplary rotation and another exemplary rotation of the resist roller in step S109 illustrated in FIG. 7A, respectively. In addition, the algorithm illustrated in the flowcharts of FIG. 7A and FIG. 7B is stored as a program in the storage part 215 and is executed by the control part 210.

At first, as illustrated in FIG. 7A, the sheet conveyance rollers such as the feeding roller 276 and the separation roller 277 start to be driven (step S101), and a sheet P starts being supplied (step S102).

Thereafter, a determination is made as to whether a tip of the sheet P is detected by the front sensor 150A (see FIG. 6) as one of the transmissive sensors 150 (step S103).

When it is determined that the tip of the sheet P is detected by the front sensor 150A (step S103: YES), a determination is made as to whether the tip of the sheet P is detected by the rear sensor 150B (see FIG. 6) as the other transmissive sensor 150 (step S104). When it is determined that the tip of the sheet P is detected by the rear sensor 150B (step S104: YES), the process proceeds to step S107.

When it is determined that the tip of the sheet P is not detected by the front sensor 150A (step S103: NO), a determination is made as to whether the tip of the sheet P is detected by the rear sensor 150B (step S105). When it is determined that the tip of the sheet P is not detected by the rear sensor 150B (step S105: NO), the process returns to step S103. When it is determined that the tip of the sheet P is detected by the rear sensor 150B (step S105: YES), a determination is made as to whether the tip of the sheet P is detected by the front sensor 150A (step S106). When it is determined that the tip of the sheet P is detected by the front sensor 150A (step S104: YES), the process proceeds to step S107.

In step S107, the tilt of the sheet P relative to the sheet width direction is detected (calculated) on the basis of a difference (temporal difference) between the timing to detect the sheet end by the front sensor 150A and the timing to detect the sheet end by the rear sensor 150B.

Then, the amount of rotation of the resist roller 281 for correcting the tilt of the sheet P is calculated on the basis of the tilt of the sheet P (step S108), and the resist roller 281 is rotated on the basis of the amount of rotation (step S109).

For example, when the tip of the sheet P is earlier detected by the front sensor 150A (step S103 and step S104), the resist roller 281 is rotated toward the downstream side in the sheet conveyance direction as illustrated in FIG. 8A. On the other hand, when the tip of the sheet P is earlier detected by the rear sensor 150B (step S105 and step S106), the resist roller 281 is rotated toward the upstream side in the sheet conveyance direction as illustrated in FIG. 8B.

Thereafter, the resist roller 281 is rotated to the home position after the tip of the sheet P passes through the resist roller 281, so that the tilt of the sheet P is corrected (step S110).

Then, a determination is made as to whether the tip of the sheet P is detected by the deviation detection sensor 282 (step S111).

When the tip of the sheet P reaches the deviation detection sensor 282 and the tip of the sheet P is detected by the deviation detection sensor 282 (step S111: YES), the amount of deviation of the sheet P is detected (step S112).

Then, the amount of movement of the resist roller 281 for correcting the deviation of the sheet P is then calculated on the basis of the amount of deviation of the sheet P (step S113), and the resist roller 281 is moved in the sheet width direction on the basis of the amount of movement so that the deviation correction is made on the sheet P (step S114).

Thereafter, a determination is made as to whether the tip of the sheet P is detected by the tip timing detection sensor 283 (step S115).

When the tip of the sheet P reaches the tip timing detection sensor 283 and the tip of the sheet P is detected by the tip timing detection sensor 283 (step S115: YES), the resist roller 281 is moved so that the deviation correction is made on the sheet P (step S116). That is, the deviation correction of the sheet P is made twice according to the present embodiment.

Then, the sheet P is adjusted in its timing to reach the secondary transfer roller 256, and thereafter, when the sheet P reaches the secondary transfer roller 256, the toner images are transferred (step S117).

As described above, the sheet position detection apparatus 100 capable of detecting a sheet position with high accuracy irrespective of a sheet state is applied to the sheet resist mechanism in the steering system for detecting a tilt in the sheet conveyance part 270, thereby correcting a tilt of a sheet with high accuracy. Further, the image formation apparatus 200 has the sheet conveyance apparatus capable of correcting a tilt of a sheet with high accuracy, thereby forming an image with excellent position accuracy.

In addition, the number of transmissive sensors 150 is not limited to two, and can be set depending on the width of a sheet P as needed. Further, the sheet position detection apparatus 100 does not necessarily need to be applied to a tilt detection sensor of the resist mechanism 280 in the sheet conveyance part 270.

First to fifth variants of the embodiment of the present invention will be sequentially described below.

Figure 9:
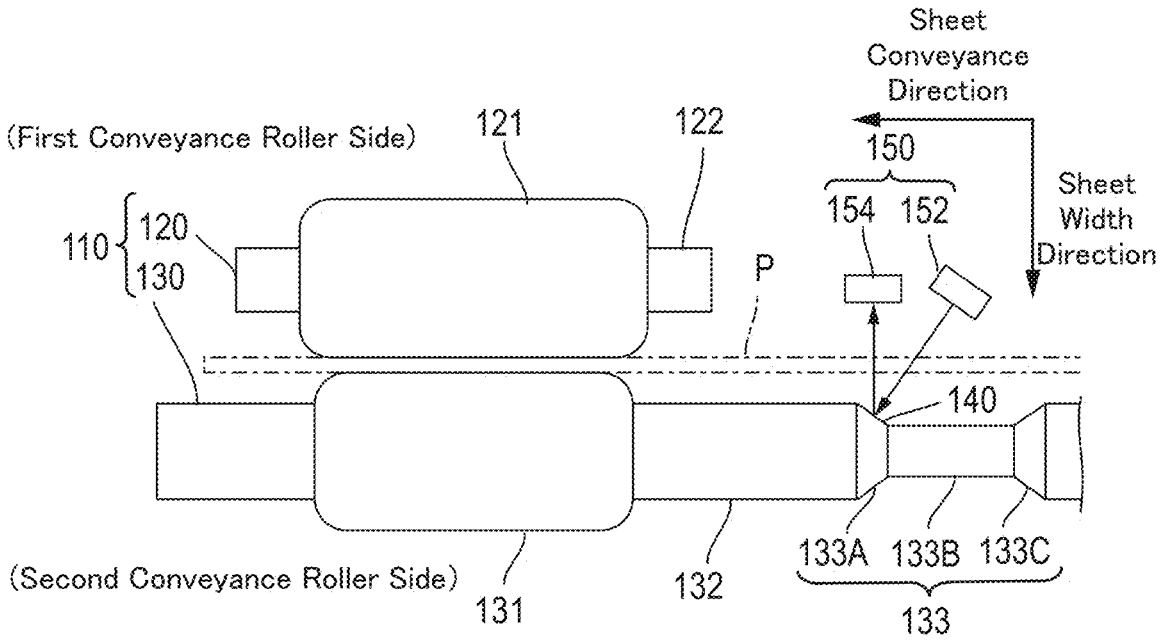
FIG. 9 is a schematic diagram for explaining a first variant of the embodiment of the present invention.
Figure 10:
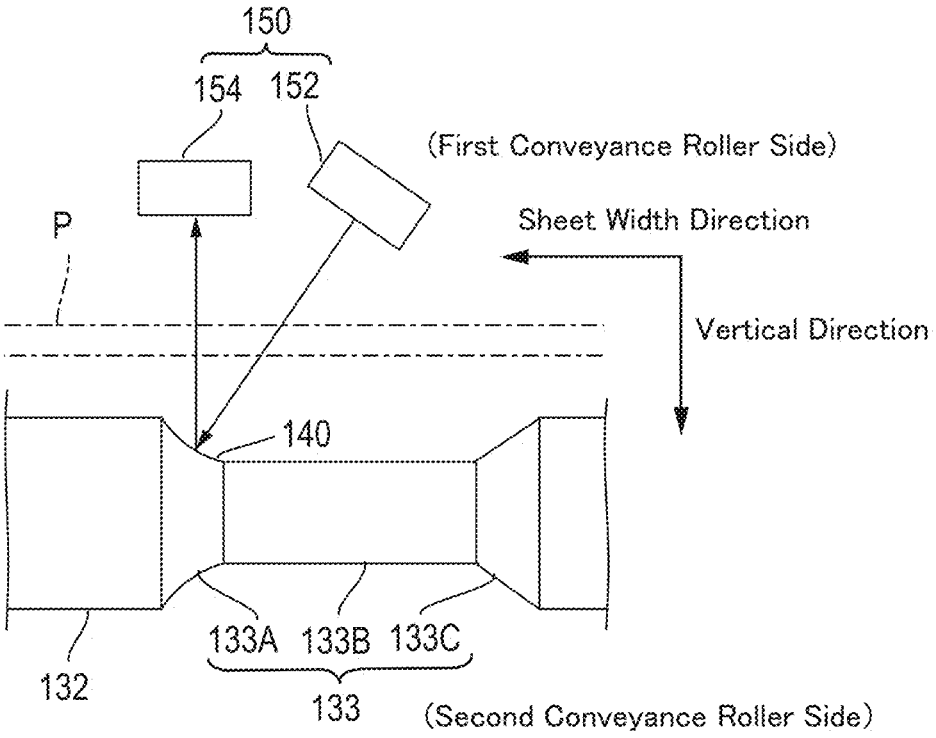
FIG. 10 is a schematic diagram for explaining a second variant of the embodiment of the present invention.

FIG. 9 and FIG. 10 are schematic diagrams for explaining the first variant and the second variant of the embodiment of the present invention, respectively.

The shaft 132 of the second conveyance roller 130 can have an atypical part 133 as in the first variant illustrated in FIG. 9.

The atypical part 133 has a first truncated cone 133A, a second truncated cone 133C, and a diameter-reduced part 133B coupling the first truncated cone 133A and the second truncated cone 133C. The first truncated cone 133A is tapered toward one end of the diameter-reduced part 133B. The second truncated cone 133C is tapered toward the other end of the diameter-reduced part 133B. The reflective face 140 for reflecting a light emitted from the light emission part 152 in the transmissive sensor 150 arranged on the first conveyance roller 120 side is configured of the first truncated cone 133A and presents a tilted shape.

In this case, the light reception part 154 in the transmissive sensor 150 can be positioned such that the direction of an incident light is orthogonal to the sheet conveyance direction. In this case, a degree of freedom of the arrangement of the light reception part 154 and the light emission part 152 increases, and in addition, the light emission part 152 and the light reception part 154 can be made closer to each other. It should be noted that the direction orthogonal to the sheet conveyance direction is parallel with the thickness direction of the sheet P.

The first truncated cone 133A configuring the reflective face 140 does not necessarily need to present a tilted shape, and can be in a curved shape as in the second variant illustrated in FIG. 10, for example. Also in this case, a degree of freedom of the arrangement of the light reception part 154 and the light emission part 152 increases, and in addition, the light emission part 152 and the light reception part 154 can be made closer to each other.

Figure 11:
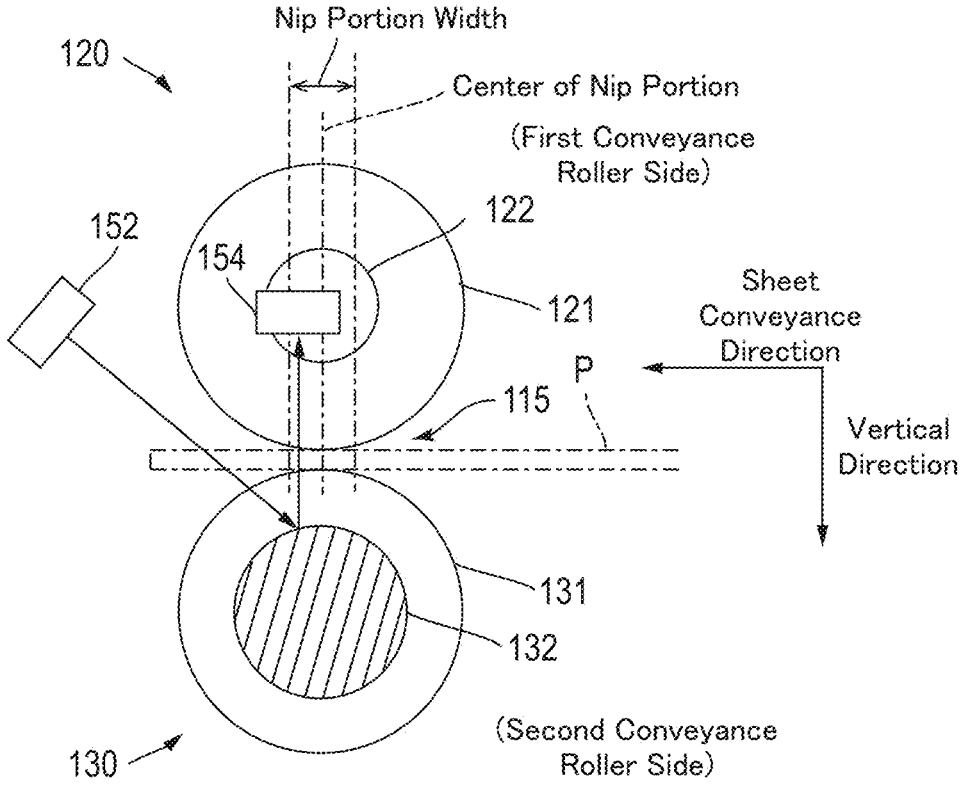
FIG. 11 is a schematic diagram for explaining a third variant of the embodiment of the present invention.

FIG. 11 is a schematic diagram for explaining the third variant of the embodiment of the present invention.

The transmissive sensor 150 can have the light reception part 154 and the light emission part 152 arranged as in the third variant of FIG. 11. Specifically, the light reception part 154 is arranged on the downstream side of the center position of the nip portion 115 in the sheet conveyance direction and is positioned such that the direction of an incident light is orthogonal to the sheet conveyance direction, and the light emission part 152 is arranged on the downstream side of the light reception part 154 in the sheet conveyance direction. Also in this case, a degree of freedom of the arrangement of the light reception part 154 and the light emission part 152 increases, and in addition, the light emission part 152 and the light reception part 154 can be made closer to each other.

Figure 12:
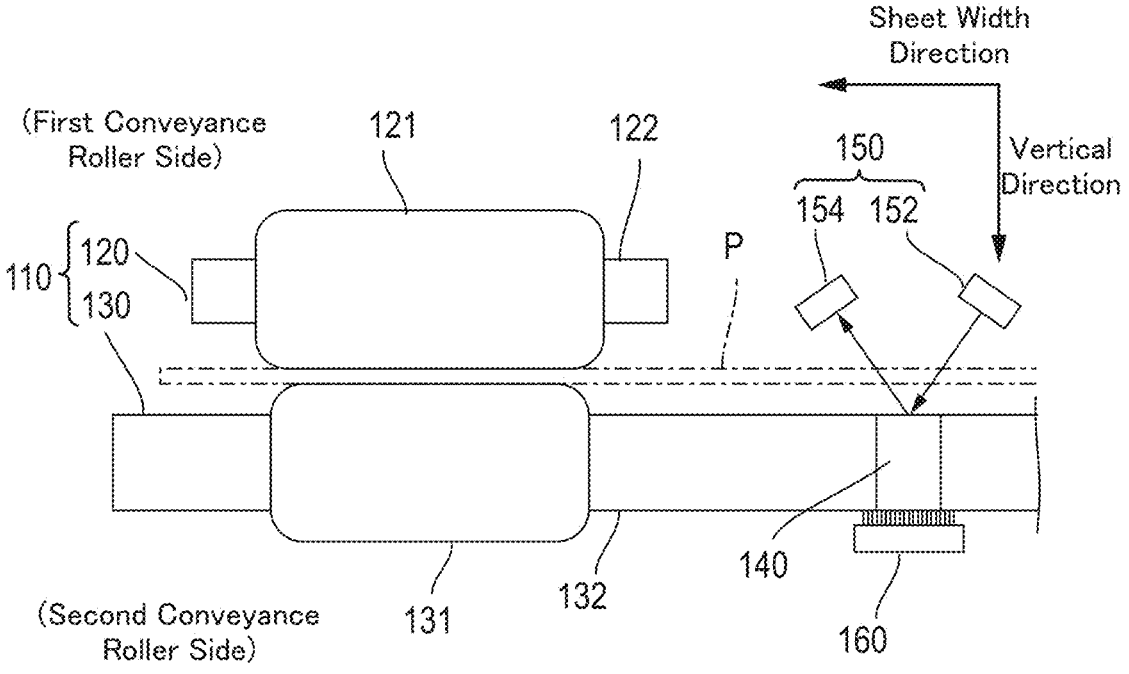
FIG. 12 is a schematic diagram for explaining a fourth variant of the embodiment of the present invention.

FIG. 12 is a schematic diagram for explaining the fourth variant of the embodiment of the present invention.

The sheet position detection apparatus 100 can have a cleaning member 160 as in the fourth variant illustrated in FIG. 12. The cleaning member 160 is in a brush shape, and is configured to clean the reflective face 140 by scrubbing contaminations of the reflective face 140. In this case, the cleanliness of the reflective face 140 is maintained (because contaminations are removed) and thus a reduction in the amount of reflected light can be restricted and the accuracy of detecting an end of a sheet P can be maintained.

The cleaning member 160 can be in a sponge shape, for example, not limited to a brush shape. Further, the cleaning member 160 can be made of a material such as MYLAR (trademark), and can scrub contaminations of the reflective face 140.

Figure 13:
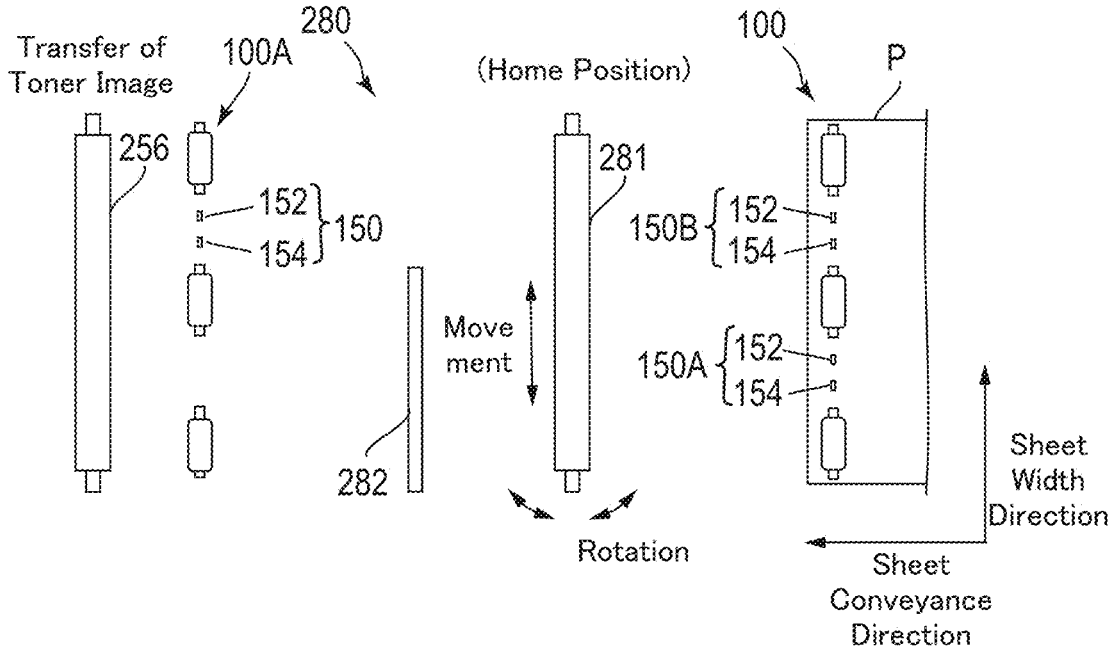
FIG. 13 is a schematic diagram for explaining a fifth variant of the embodiment of the present invention.

FIG. 13 is a schematic diagram for explaining the fifth variant of the embodiment of the present invention.

The sheet conveyance part 270 can have a second sheet position detection apparatus 100A as in the fifth variant illustrated in FIG. 13. The sheet position detection apparatus 100A is applied as the tip timing detection sensor 283 (FIG. 6), is arranged between the deviation detection sensor 282 and the secondary transfer roller 256, and is used to detect a tip of the sheet P and to adjust a timing when the sheet P reaches the secondary transfer roller 256.

The sheet position detection apparatus 100A does not detect a tilt of a sheet P and thus has a single transmissive sensor 150, but can have a plurality of transmissive sensors 150 not particularly limited to the single one. Further, the sheet position detection apparatus 100A can be independently used not limited to being used together with the sheet position detection apparatus 100 for detecting a tilt of a sheet P.

As described above, it is possible to provide the sheet position detection apparatus capable of detecting a sheet position with high accuracy irrespective of a sheet state, the sheet conveyance apparatus, and the image formation apparatus according to the present embodiment.

The present invention is not limited to the aforementioned embodiment, and can be variously modified within the scope of claims. For example, the first to fifth variants can be combined as needed. Further, the sheet position detection apparatus does not necessarily need to be applied to the sheet conveyance part (sheet conveyance apparatus) in the image formation apparatus. Further, the image formation apparatus is not limited to MFP.

Although embodiments of the present invention have been described and illustrated in detail, it is clearly understood that the same is by way of illustration and example only and not limitation, the scope of the present invention should be interpreted by terms of the appended claims.

What is claim is:

1. A sheet position detection apparatus comprising:

a first conveyance roller and a second conveyance roller which are arranged to oppose across a sheet to be conveyed and to nip the sheet; and a detector that detects an end position of the sheet, wherein the detector has a light emitter and a light receptor arranged on the first conveyance roller side, wherein the light emitter and the light receptor are arranged such that a light emitted from the light emitter is reflected on a reflective face of the second conveyance roller and enters the light receptor, and wherein the detector detects passage of an end of the sheet on the basis of a change in an amount of an incident light entering the light receptor when the sheet shields a light emitted from the light emitter;

wherein the detector is configured and positioned to detect the passage of the end of the sheet at the nip portion defined between the first conveyance roller and the second conveyance roller.

2. The sheet position detection apparatus according to claim 1, wherein the light receptor is positioned such that a direction of the incident light is orthogonal to a direction in which the sheet is conveyed.

3. The sheet position detection apparatus according to claim 1, wherein the reflective face is configured of a cylindrical part of the second conveyance roller.

4. The sheet position detection apparatus according to claim 3, wherein the cylindrical part is a roller shaft of the second conveyance roller.

5. The sheet position detection apparatus according to claim 3, wherein the light emitter and the light receptor are arranged apart in an axial direction of the first conveyance roller, and the reflective face is in a tilted shape or curved shape.

6. The sheet position detection apparatus according to claim 5, wherein the light receptor is positioned such that a direction of the incident light is orthogonal to a direction in which the sheet is conveyed.

7. The sheet position detection apparatus according to claim 3, wherein the light receptor is arranged on a downstream side of a center position of a nip portion between the first conveyance roller and the second conveyance roller in the sheet conveyance direction, and wherein the light emitter is arranged on a downstream side of the light receptor in the sheet conveyance direction.

8. The sheet position detection apparatus according to claim 7, wherein the light receptor is positioned such that a direction of the incident light is orthogonal to the sheet conveyance direction.

9. The sheet position detection apparatus according to claim 1, wherein the second conveyance roller has a mirror-finished mirror face, and the reflective face is configured of the mirror face.

10. The sheet position detection apparatus according to claim 1, further comprising:

a cleaning member that cleans the reflective face.

11. The sheet position detection apparatus according to claim 1, wherein the first conveyance roller is positioned vertically above the sheet.

12. A sheet conveyance apparatus comprising the sheet position detection apparatus according to claim 1.

13. The sheet conveyance apparatus according to claim 12, comprising:

a resist mechanism in a steering system configured to correct a tilt of the sheet, wherein a plurality of detectors in the sheet position detection apparatus are arranged apart in an axial direction of the first conveyance roller, and can detect a tilt of the sheet, and wherein the resist mechanism corrects a tilt of the sheet on the basis of the tilt of the sheet detected by the detectors.

14. An image formation apparatus comprising:

the sheet conveyance apparatus according to claim 12; and an image former that forms an image on a sheet conveyed by the sheet conveyance apparatus.

15. The image formation apparatus according to claim 14, wherein the sheet conveyance apparatus has a resist mechanism in a steering system that corrects a tilt of the sheet, wherein a plurality of detectors in the sheet position detection apparatus are arranged apart in an axial direction of the first conveyance roller, and can detect a tilt of the sheet, and wherein the resist mechanism corrects a tilt of the sheet on the basis of the tilt of the sheet detected by the detectors.

16. The image formation apparatus according to claim 14, wherein the image formation part has a secondary transfer roller that transfers a toner image onto the sheet, and wherein the detector in the sheet position detection apparatus detects passage of an end of the sheet in order to adjust a timing when the sheet reaches the secondary transfer roller.

* * * * *